US009776222B2

(12) United States Patent
Fiorentini

(10) Patent No.: US 9,776,222 B2
(45) Date of Patent: Oct. 3, 2017

(54) METHOD FOR REMOVING CONTAMINATING PARTICLES FROM CONTAINERS

(75) Inventor: Lorenzo Paolo Dante Fiorentini, Pisa (IT)

(73) Assignee: Gerresheimer Glas Gmbh, Dusseldorf (DE)

( * ) Notice: Subject to any disclaimer, the term of this patent is extended or adjusted under 35 U.S.C. 154(b) by 334 days.

(21) Appl. No.: 12/991,447

(22) PCT Filed: May 14, 2009

(86) PCT No.: PCT/EP2009/003431

§ 371 (c)(1),
(2), (4) Date: Jan. 5, 2011

(87) PCT Pub. No.: WO2009/138231

PCT Pub. Date: Nov. 19, 2009

(65) Prior Publication Data

US 2011/0100401 A1 May 5, 2011

(30) Foreign Application Priority Data

May 14, 2008 (EP) ..... 08103961

(51) Int. Cl.
*B08B 9/02* (2006.01)
*B08B 9/34* (2006.01)
(Continued)

(52) U.S. Cl.
CPC ..... *B08B 9/34* (2013.01); *B08B 6/00* (2013.01); *B08B 9/42* (2013.01)

(58) Field of Classification Search
CPC .. B08B 9/286; B08B 6/00; B08B 9/34; B08B 9/42
(Continued)

(56) References Cited

U.S. PATENT DOCUMENTS 3,071,497 A * 1/1963 Hinson ..... 134/1
3,684,575 A * 8/1972 King ..... 134/1
(Continued)

FOREIGN PATENT DOCUMENTS

JP 03-143582 A 6/1991
JP 06-007200 U 1/1994
(Continued)

*Primary Examiner* — Katelyn Whatley
(74) *Attorney, Agent, or Firm* — McCormick, Paulding & Huber LLP

(57) ABSTRACT

A method and a device (50) for removing fragments and/or particles from containers, such as in particular glass tubes (5), provides means for adjusting the electrostatic force (40) in the tubes (5) and means for removing (60) of the fragments. The means for removing (60) can comprise a jet of fluid, of measured speed, put in the containers (5) by a nozzle (2), whereas the means for adjusting the electrostatic force (40) can comprise an element (1) for putting an electrically conducting fluid (8) with a measured resistivity in the containers (5). This way, the fluid (8), for example ionized air, acts in order to reduce and/or eliminate the electrostatic charge, and therefore the electrostatic force, between the fragments (30) and the surface of the containers, assisting the removal by means of jets of fluid or by suction means.

23 Claims, 11 Drawing Sheets

(51) Int. Cl.
*B08B 6/00* (2006.01)
*B08B 9/42* (2006.01)

(58) Field of Classification Search
USPC ..... 134/22.12, 1, 166 C; 15/406, 1.51
See application file for complete search history.

(56) References Cited

U.S. PATENT DOCUMENTS

| | | | | |
|---|---|---|---|---|
| 5,409,545 | A | 4/1995 | Levey et al. | |
| 5,700,327 | A | 12/1997 | Babacz et al. | |
| 2003/0115710 | A1 | 6/2003 | Choi | |
| 2004/0011764 | A1 | 1/2004 | De Vries et al. | |
| 2007/0240784 | A1 * | 10/2007 | Wu et al. ..... | 141/89 |

FOREIGN PATENT DOCUMENTS

| | | | | |
|---|---|---|---|---|
| JP | 07-100449 | A | | 4/1995 |
| JP | 07-1004499 | A | | 4/1995 |
| JP | 07100449 | A | * | 4/1995 |
| JP | 08-133775 | A | | 5/1996 |
| JP | 08133775 | A | * | 5/1996 |
| JP | 11-217230 | A | | 8/1999 |
| JP | 2002-153830 | A | | 5/2002 |
| JP | 2002-289394 | A | | 10/2002 |
| JP | 2002-308231 | A | | 10/2002 |
| JP | 2008104958 | | | 5/2008 |

* cited by examiner

Fig.11
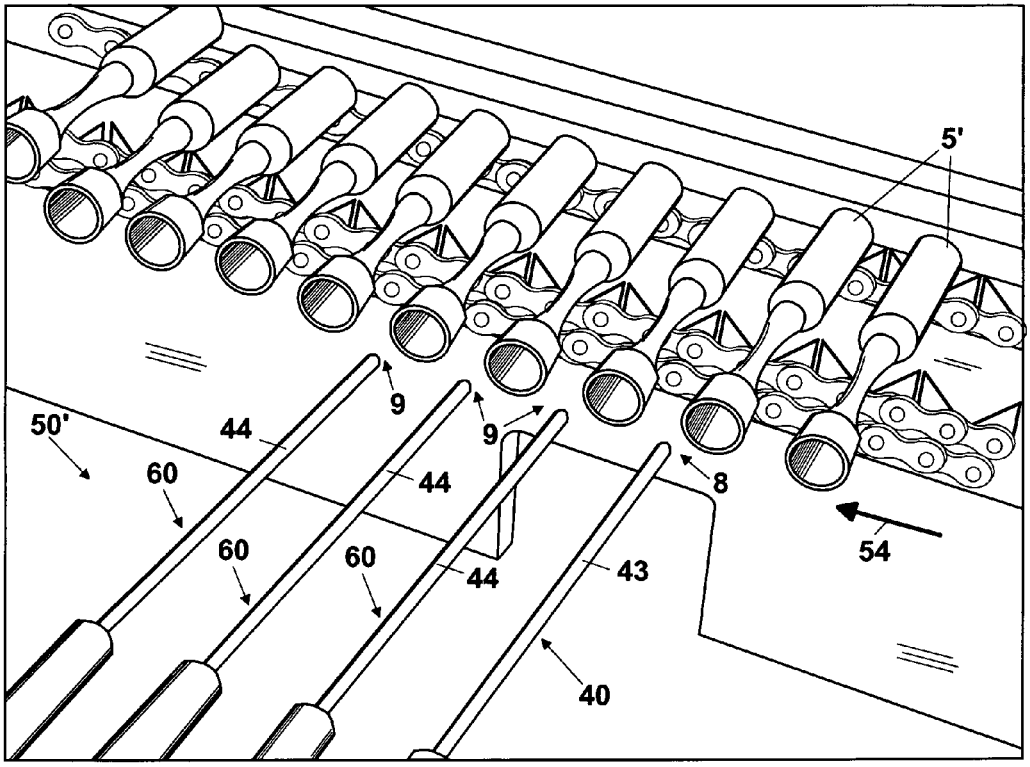
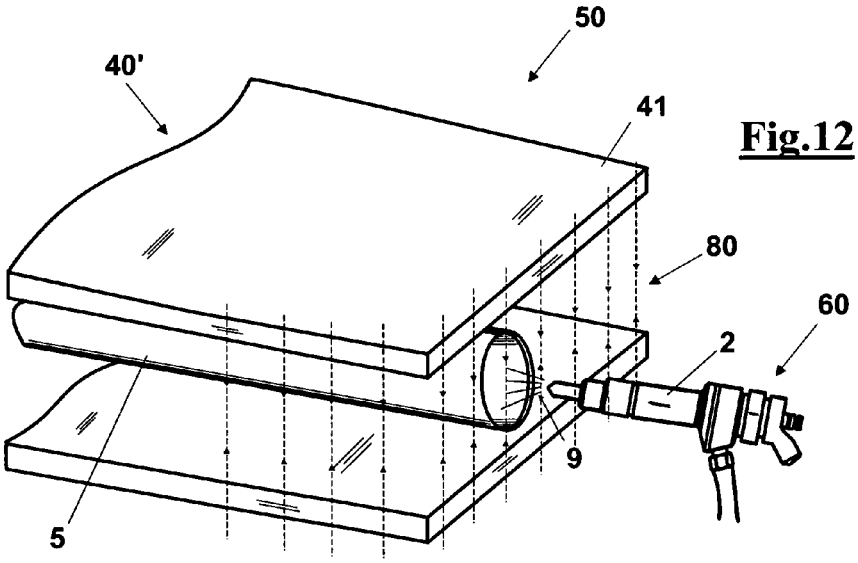
Fig.12

METHOD FOR REMOVING CONTAMINATING PARTICLES FROM CONTAINERS

FIELD OF THE INVENTION

The present invention relates to the field of tubular glass manufacturing and converting, and in particular, it relates to a method and to a device for removal of fragments and/or particles from tubes or from containers obtained form glass tube, on automatic production lines.

Furthermore, this invention can be applied even at other types of products that require high quality.

In the following description, where fragments are cited, it is to be understood that the term refers to both fragments of the same material with which the container is made (e.g. glass), and to particles of different material, which can adhere to the surfaces of the container.

BACKGROUND OF THE INVENTION

The production of tubes of glass or other types of containers obtained from glass tubes, according to the state of the art, is particularly relevant owing to the many critical applications where they are used, particularly in the health industry.

Among the many articles that are industrially produced starting from a glass tube, for example, containers can be cited used in the pharmaceutics industry such as vials, ampoules, cartridges, syringes, as well as laboratory apparatus, such as graduated cylinders, pipets, burets, refrigerants, etc., adopted in chemical laboratories.

In the industrial field, a raw glass tube has to comply with particular quality regulations and predetermined dimensional characteristics before being allowed on successive production lines.

For example, the pharmaceutical industry demands glass tubes which meet particular requirements, and, in particular, a high chemical stability, a low thermal expansion coefficient (which makes it resistant to relevant temperature changes), and strictly controlled dimensional characteristics, in order to ensure maximum quality and production efficiency for the above described products. In particular the glass has to be free from fragments or particles both on its outer surface and especially on its inner surface. For most uses in the pharmaceutical field, glass containers shall contain "no particles", and the producers have to assure absence of particles from the products.

However, the production process for the tubes involves necessarily generation of fragments, for the peculiar nature of the material and, in particular, owing to the various cut and work operations made on glass.

In more detail, after hot forming downstream of the oven, the glass tube is cut a first time at a length not much longer than the final use. The cutting equipment is a rotating device, synchronised with the glass tube drawing speed, which causes the continuous tube to be cut in a cutting point by a rotating blade.

A further cutting step is done on both ends of the tube up to refine the cut and to obtain the final desired length with the desired tolerances.

The above described cutting steps generate fragments and/or particles that can adhere outside or within the tube. Even other events where freshly cut surfaces are involved, are potential sources of contaminating particles such as, for example, the contact with conveying guides or aligning wheels or other parts of the machines or the packages.

The production process comprises, before packaging or storing the tube as semifinished product, at least one process step dedicated to extract glass fragments or other particles from the inside of the tube.

The fragments or particles that adhere on the outer surface can be easily removed with brushing, washing or jets of air. The removal of those that adhere on the inner surface, instead, cannot be obtained with the same ease.

According to the prior art, the extraction step of the fragments or particles that adhere on the inner surface of the tubes uses a fluid jet, such as air, with a determined speed, directed into the tubes for eliminating the stuck fragments.

It must be noted that, in case of failure or incomplete effectiveness of the extraction step, the final requirements of the product are not met, especially in the pharmaceutical industry, in that the fragments, because of the peculiar hardness, brittleness and sharpness of glass, are a potential source of highly harmful consequences and certainly cannot be accepted in a container for injectable preparations.

To overcome this disadvantage, further steps of inspection and selection, and measures such as washing steps are carried out on the finished containers before the filling process, and the products that are out of quality ranges follow further treatments or analysis, or are rejected, thus affecting in both cases the costs and the production time.

Furthermore, a complementary limitation to the above described cleaning operations occurs when standard containers are produced and sold closed and ready to the use. These containers, such as in particular "D-form" ampoules or RTF® syringes (Ready To Fill), are conceived for a direct filling without washing and are therefore required to meet the highest quality requirements, in particular the absolute absence of fragments and/or particles already when they exit from the first production line.

Among the drawbacks concerning the extraction step described above, this method can eliminate only one part of the fragments, leaving a remaining amount of fragments still stuck to the container. This is due, mainly, to the fact that they adhere to the inner surfaces of the tube by means of electrostatic forces that an air jet cannot overcome. Such forces are due to presence of electric charges on the fragments and/or particles at the end of the tube manufacturing steps and particularly after the cutting process.

Various systems are known for reducing or eliminating the electrostatic forces that may cause fragments to adhere to the inner surfaces of containers, by using ionized air.

US2007240784A1 and US2003115710A1 describe a method adapted to remove particles from bottles of plastics that are arranged upside-down. A jet of ionized air enters the bottles, and then a jet of normal air follows to remove the particles. This method is not suitable for glass tubes, which are long and cannot proceed vertically.

U.S. Pat. No. 3,071,497A describes a method adapted to remove particles from glass containers like ampoules vials, syringes, cartridges, used for containing drugs and pharmaceutical products. The method provides blowing externally a jet of ionized air and then applying a mechanical vibration to the container that is oriented with its mouth towards below, so that the particles may fall by gravity. Also in this case the method is not adapted for long glass tubes, like those object of the present application. Also in case of short glass tubes, or container made by glass tubes, the method of U.S. Pat. No. 3,071,497A cannot be used, owing to the very strict requirements concerning fragments or particles.

SUMMARY OF THE INVENTION

It is a general object of the present invention to provide a method for removal of fragments and/or particles from glass tubes or containers obtained from glass tubes, on automatic production lines, which overcomes the above described problems.

It is another feature of the present invention to provide a method for removal of fragments and/or particles from glass tubes or containers obtained from glass tubes, on automatic production lines, which gives, as output, containers which guarantee an absence of fragments below a determined probability.

It is also a feature of the present invention to provide a device adapted to apply the above described method for achieving the same objects.

It is a further feature of the present invention to provide a device for removing fragments and/or particles from containers, on automatic production lines, which is structurally easy and of simple use.

It is also a feature of the present invention to provide a device for removing fragments and/or particles from containers that is flexible and adaptable to a desired kind of product and to a desired kind of automatic production lines.

It is yet a feature of the present invention to provide a device for removing fragments and/or particles from glass tubes or containers obtained from glass tubes with both ends open, or with an open end and a closed end.

These and other objects, in a first aspect of the invention, are achieved by a method for removal of fragments from glass tubes or containers obtained from glass tubes, on automatic production lines, where said glass tubes or containers obtained from glass tubes are conveyed on a conveying line laying horizontally, comprising the steps of:

- conveying said glass tubes or containers obtained from glass tubes laying horizontally;
- changing, i.e. reducing or eliminating, the electrostatic force between said fragments and the inner surface of said glass tubes or containers obtained from glass tubes,
- displacing said fragments from the inner surface of said glass tubes or containers obtained from glass tubes, and
- blowing said fragments away from the inner surface of said glass tubes or containers obtained from glass tubes.

Advantageously, said step of changing the electrostatic force is selected from the group comprised of:

- changing the electric charge of said fragments
- changing the electric charge of said glass tubes or containers obtained from glass tubes
- changing the electric field that acts on said fragments and/or on said glass tubes or containers obtained from glass tubes,
- a combination thereof.

Preferably, said steps of changing and displacing and removing are carried out in a way selected from the group comprised of:

- at three successive stations along said conveying line for said glass tubes or containers obtained from glass tubes;
- in two stations, along said conveying line for said glass tubes or containers obtained from glass tubes;
- in one single station, along said conveying line for said glass tubes or containers obtained from glass tubes.

Advantageously, said step of removing is carried out introducing at least one jet of fluid with a measured speed, for example air, in said containers.

In a first exemplary implementation of the method, said step of changing the electric charge, provides the introduction of an electrically conducting fluid with a measured resistivity in said containers.

Advantageously, said electrically conducting fluid is obtained from an electrically neutral gas, such as air that is previously ionized.

In particular, a step is provided of ionization of the gas before the introduction of said fluid in said container, said step of ionization providing, in particular by means of collisions between the molecules of the fluid that are accelerated by suitably intense electric fields, a subtraction or addition or exchange of electrons between said molecules, and a rapid increase of the fraction of molecules of the fluid that are electrically charged. Advantageously, said step of displacing is obtained by communicating a mechanical momentum perpendicular to the tube axis to the said fragments. In particular, said mechanical momentum is obtained by applying vibrations of determined frequency, amplitude and polarization, to the outer surface of said glass tubes or containers obtained from glass tubes.

Preferably, said vibrations are applied by means of a suitable vibrating element, which includes a means for ensuring proper contact with said glass tubes or containers obtained from glass tubes.

In the first exemplary embodiment of the method, such means for ensuring proper contact are based on letting the tube lay by its own gravity on the transducer surface. Alternatively, such means for ensuring proper contact provides a contrast element which touches said glass tubes or containers obtained from glass tubes from above forcing contact on the vibrating element below.

Advantageously, said frequencies are higher than 50 Hz, preferably higher than 1 KHz, most preferably said frequencies are higher than 20 KHz.

Preferably, the displacing step is carried out in a station coincident with the removing step. In particular, if said steps of changing and removing occur at two successive stations, said step of displacing occurs simultaneously with said step of removing, and said electrically conducting fluid and said jet of fluid are introduced respectively with different flow rates and outflow speeds in order to enhance the effect of both the ionized fluid and the fluid for removing the fragments, limiting in the meantime the costs.

Alternatively, if said steps of changing and removing occur in a same station, said step of displacing occurs simultaneously with both steps of changing and removing, and said electrically conducting fluid and said jet of fluid for removing the fragments are mixed according to a determined ratio, or said electrically conducting fluid works at the same time as a medium for adjusting the electrostatic force and as a medium for removing the fragments, such that the stations are simpler and the fragments removal is more efficient.

In a second exemplary implementation of the method, said step of changing provides causing said containers to be immersed in an external electric field, in particular causing said containers to pass between opposing surfaces of a plane parallel electrical capacitor; in particular said electric field being switched alternately through a plurality of polarities such that electrostatic adhesion force acting on said fragments and said containers are temporarily reduced or reverted[1].

In this case, advantageously, said steps of changing and removing occur in a same station, i.e. during a passage through said capacitor, an introduction in said containers of a jet of fluid is made.

In a further exemplary implementation of the method, the step of changing and removing occur with both the injection in said containers of the electrically conducting fluid and, at the same time, the immersion of said containers in an external electric field.

Advantageously, such step of removing employs a suction phase downstream of said step of injection of the jet of fluid, adapted to receive it after it exits the said tube or container, to prevent removed fragments from contaminating the environment, and to provide for enhanced pressure difference to same jet.

According to another aspect of the invention, a device for removing fragments from glass tubes or containers obtained from glass tubes, on automatic production lines, comprises:

- means for conveying said glass tubes or containers obtained from glass tubes laying horizontally;
- means for changing, reducing or eliminating, the electrostatic force between said fragments and the inner surface of said glass tubes or containers obtained from glass tubes;
- means for displacing said fragments from the inner surface of said glass tubes or containers obtained from glass tubes;
- means for removing said fragments from said glass tubes or containers obtained from glass tubes.

In particular said means for adjusting the electrostatic force are selected from the group comprised of:

- means for adjusting the electric charge of said fragments and/or of said containers;
- means for adjusting the electric field that acts on said fragments and/or on said containers;
- a combination thereof.

Preferably, said means for displacing comprises at least one vibrating element, for example a transducer, capable of transferring a mechanical momentum of determined frequency, amplitude and polarization, perpendicular to the tube axis, after the operation of said means for adjusting the electrostatic force, or simultaneously to it.

Preferably, said means for removing comprises at least one jet of fluid, for example air, of measured speed, put in said containers after the operation of said vibrating means for displacing the fragments, or simultaneously to it.

Advantageously, said means for adjusting the electrostatic force, according to a first exemplary embodiment, comprises:

- means for putting an electrically conducting fluid with a measured resistivity in said containers, said fluid being adapted to reduce and/or eliminate the electrostatic charge and therefore the electrostatic force between said fragments and the surface of said containers.

Preferably, said electrically conducting fluid is a ionized fluid, in particular air, and said means for putting an electrically conducting fluid comprises in particular a fluid ionizer.

This way, the electrically conducting fluid, such as the ionized air, injected in the containers, laps the fragments, stuck to the walls owing to electrostatic forces, allowing the partial or total neutralization of the electrostatic charge present on them, with the opposite charge present in the fluid. In this way part of the electric charge present on the fragments is transferred to the fluid. Similar phenomena occur simultaneously and symmetrically for an opposite charge induced on the inner surface of the container at the point of adhesion of the fragments, so that the overall result is the compensation, by the fluid conductor, of the electrostatic charge present respectively on the fragments and on the inner surface of the glass tubes or containers obtained from glass tubes, which is responsible of the sticking force.

The longer the time the fluid stays in the containers, the higher the concentration of the ions, the higher the efficiency of the neutralization process.

In the advantageous embodiment, the employment of the at least one vibrating element in contact with the outer surface of the tube or container, which communicates mechanical momentum of given polarization, frequency and amplitude to the tube or container, causes the fragments to be easily displaced, i.e. lifted off, from the inner surface of the tube or container, in order to exploit the effect that the electrostatic force that caused them to stick has been reduced and/or eliminated by the ionized air.

The means providing a jet of fluid, of measured speed, causes the displaced fragments that have been displaced out of the region near the inner surface, called "boundary layer", where the fluid speed is low, and that now are in the zone where the fluid can reach full velocity, and the fluid can effectively drag the fragments away and out of the glass tubes or containers obtained from glass tubes. Preferably, said means for adjusting the electrostatic force and said means for removing are arranged respectively in succession, and said means for displacing operates in coincidence with said mean for removing.

In particular said electrically conducting fluid and said jet of fluid are introduced respectively with different flow rate and outflow speed in order to reduce air consumption and limiting the costs.

Alternatively, said means for adjusting the electrostatic force and said means for removing are arranged on said automatic production line in coincidence to each other and said means for displacing operates in coincidence with both of them. In this case, said electrically conducting fluid and said jet of fluid are mixed according to a determined ratio, or said electrically conducting fluid works at the same time as medium for adjusting the electrostatic force and as medium for removing the fragments, in a way the simplifies the structure and maximizes the fragment extraction efficiency.

Advantageously, said means for adjusting the electrostatic force and said means for removing are put in, according to a determined depth, beyond the opening of said containers. In particular this solution is effective for containers having a closed end.

This way, the electrically conducting fluid, as well as the jet of fluid, have a wider action field and reach the fragments located deep and on the bottom of the container.

Preferably, sensor means are provided adapted to operate automatically said means for changing the electrostatic force and said means for displacing and said means for removing, according to the presence and the position of said containers.

In a second exemplary embodiment[2], said means for adjusting the electrostatic force, comprises:

- a capacitor device adapted to receive said containers and cause them to be immersed in an electric field, said electric field being switched alternately through a plurality of polarities, reducing momentarily the force of electrostatic adhesion between said fragments and said containers.

This way, the containers that pass through the condenser, are subject to an external variable electric field so that the electrostatic force of the stuck fragments on the inner and outer surface is momentarily reduced and/or eliminated. In particular, the polarity of the external electrostatic field can be alternated with determined timing. This allows adjusting the force of adhesion acting on the fragments, either negative or positive stuck on the surfaces of the container.

The successive or simultaneous step, as in the previous case, provides the introduction of a jet of fluid that removes definitively the fragments from the inner surfaces of the containers.

Advantageously, suction devices are provided at opposite sides with respect to said means for adjusting the electrostatic force and to said means for removing, adapted to receive and to prevent said fragments from exiting in the environment.

BRIEF DESCRIPTION OF THE DRAWINGS

The invention will be made clearer with the following description of an exemplary embodiment thereof, exemplifying but not limitative, with reference to the attached drawings wherein:

FIG. 11 shows the device for removing fragments mounted on a production line of containers having a closed end, as those shown in FIGS. 9 and 10;

FIG. 12 shows a diagrammatical view of the condenser adapted to apply an external electrostatic field through which the containers pass, according to the invention;

DESCRIPTION OF PREFERRED EXEMPLARY EMBODIMENTS

Figure 1:
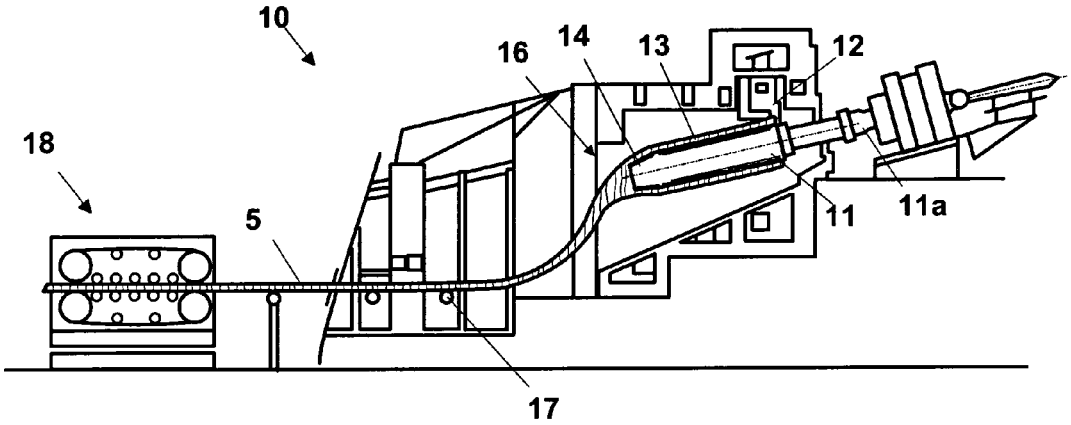
FIG. 1 shows a diagrammatical view of the production apparatus with rotating mandrel for making the glass tube.

With reference to FIG. 1 a horizontal automatic production system 10 is depicted diagrammatically, which represents the most common, practical, precise and flexible known process for making a glass tube, with diameters and thicknesses that cover most of the needs of the market.

In particular, the horizontal system 10 consists of a tube of refractory material (mandrel), suitably treated and mounted on a rotating axis 11*a* of special steel, on which, by a "casting beak" 12 a continuous stream of glass 13 flows.

Then, the glass 13 that flows from the "casting beak" 12 and that is suitably fluid and homogeneous to expand about mandrel 11, reaches end 14, where it is blown and starts running as a continuous tube 5.

In particular, mandrel 11 is enclosed in an oven or "muffle" 16 at an predetermined temperature, to ensure a controlled cooling of glass 13 and to avoid size defects in the wall of the tube 5, and has a fixed and controlled speed. In detail, the support axis 11*a* has an axial recess (not shown) through which air is blown for adjusting the size of the tube same.

The running glass tube 5 is at first supported by rollers of graphite 17 of a conveying track, up to reaching a so-called "puller" 18, i.e. a machine that pulls automatically and rotates the tube 5 following the continuous rotational movement imparted by mandrel 11, and avoiding deformation of the final product.

In a successive step, not shown in the figures, immediately after puller 18, the tube 5 is cut to a length a little bit longer than the desired final length. The cutting system provides a plurality of devices that combine an incision, a thermal shock and a mechanical stress in order to cut the tube.

At the end of the production line, a selecting device (not shown) provides automatically to send to a crusher the rejected tubes if their size or quality are out from particular prescribed ranges, whereas the accepted tubes pass directly to a machine for operating a cut at the final length.

Figure 2:
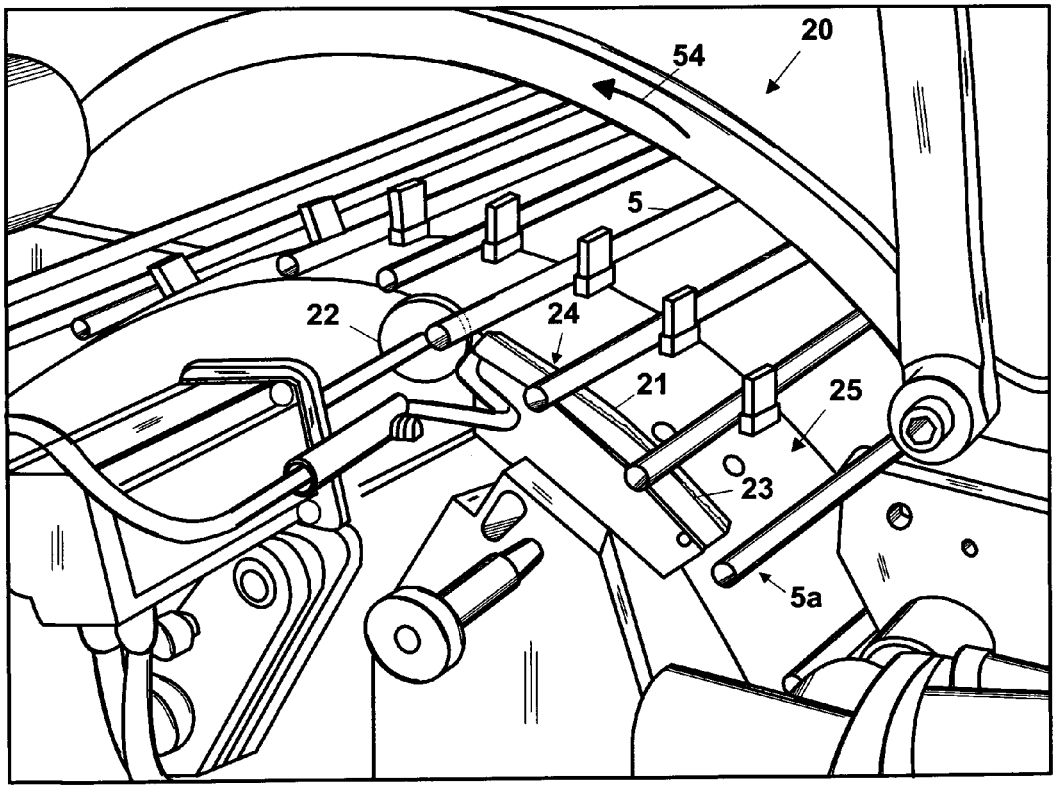
FIG. 2 shows a perspective view of an apparatus for precisely cutting the glass tube, which is one of the main sources of generating the fragments.

With reference to FIG. 2, an apparatus is shown in detail, indicated as 20, for cutting the tube at a final desired length, or thermal shock "trim", in a way known in the prior art. In particular it is mounted on a conveying line 25 and cuts tube 5 at both ends 5*a* by a respective burner 21, at high temperature, and by cutting wheels 22, which are cooled with water and arranged at opposite sides.

In particular FIG. 2 shows the cutting step of a single end 5*a* of the tube 5. Burner 21 produces a flame 23 with a thin core at a high temperature directed in a way suitable to concentrate the heat in a cutting zone 24 through which only glass tube 5 passes. The combined effect of the superheating with the following sudden cooling, caused by the contact on cold wheel 22 causes a clear cut.

The following step, not shown, comprises, instead, a step of burning the ends. This step gives to the glass tube 5 more resistance at the ends and also a better aesthetic effect.

The above described process steps of and, in particular, the two cutting and aligning steps, not described, cause the generation of fragments and/or particles, specifically glass fragments 30 (shown in FIGS. 7 and 8), which adhere to the inner surfaces of glass tube 5.

A quality problem occurs for the inner surfaces of container 5, which will eventually contact the substance contained inside, for example, drugs or injectable liquids.

Materials like glass contain normally an identical number of positive and negative charges. Operations such as rubbing, handling, cutting or releasing, during the production process, can affect this balance and cause the charge between the bodies or surfaces, and, in particular, on the surface and/or the fragments, to break this neutrality.

Therefore electrostatic forces are generated that cause the fragments and/or the particles 30 to adhere inside the walls of the glass tube 5 and in a not easily removable way, thus affecting the quality or the conformity of the final product, for example in the pharmaceutics industry where a high quality is required. Such particles are particularly difficult to remove from long thin glass tubes.

Figure 3:
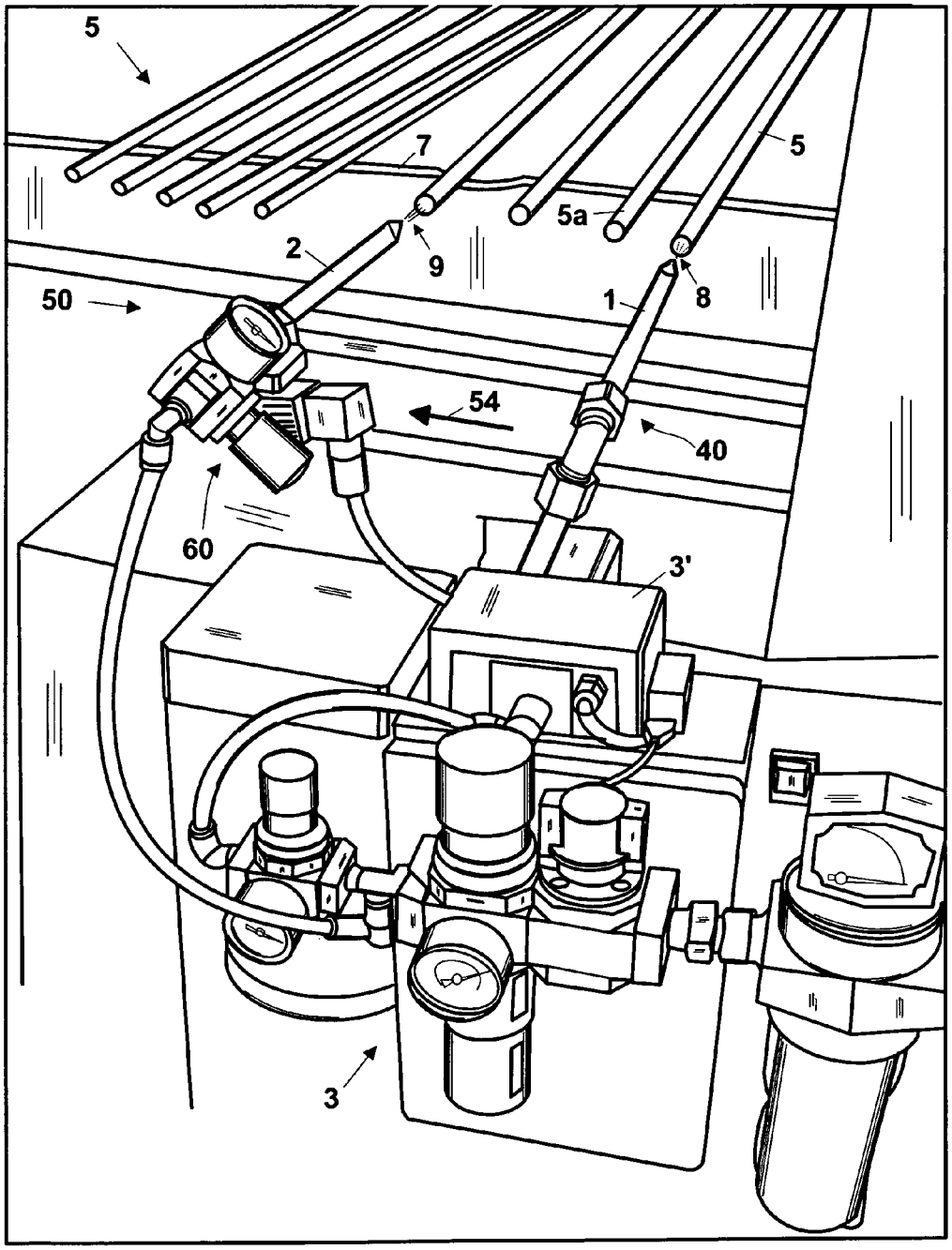
FIG. 3 shows an overall view of a device for removing fragments, on automatic production lines of containers, according to the invention.

With reference to FIG. 3 an overall view is shown of a device 50 for removing fragments and/or particles from glass tubes 5, according to an exemplary embodiment of the present invention.

In particular, the device 50 comprises a means for adjusting the electrostatic force 40 and a means 60 for removing the fragments. In an exemplary embodiment not shown it is possible to provide, furthermore, a combination of both methods.

In detail, the means for adjusting the electrostatic force comprises a means 40 for adjusting the electric charge of the fragments 30 and/or the tubes 5 or a means 40' (shown in FIG. 12) for adjusting momentarily the electric field that acts on the fragments 30 and/or on tubes 5.

To explain this distinction, the well known law $F=qE$ involves the electrostatic force (F), the charge (q) and the electric field (E). In particular the electrostatic force (F) is the product between the charge (q) and the electric field (E).

According to this formula the electrostatic force can be, then, changed by acting either on the electric charge or on the electric field.

The solution depicted in FIGS. from 3 to 10, that are now described, represents the means 40 for adjusting the electric charge of the fragments 30 and/or the tubes 5, whereas the solution with the condenser (visible in FIG. 12) represents the means 40' that vary the electric field, in particular by means of an external electrical source.

In the exemplary embodiment of FIG. 3 the means for removing 60 comprises a fluid jet 9, of measured speed, introduced in tubes 5 by an injector 2, whereas the means for adjusting the electrostatic force 40, according to a first exemplary embodiment, comprises an element 1 for introducing an electrically conducting fluid 8 with a measured resistivity in tubes 5.

In particular the electrically conducting fluid 8 is a ionized fluid, in particular air, and the means 40 for providing the electrically conducting fluid 8 comprises a ionizer 3' of fluids.

The ionization of fluid 8 causes in particular hits between the molecules of the fluid that are accelerated by suitably intense electric fields, with a subtraction or addition or exchange of electrons between said molecules.

This way, the electrically conducting fluid 8, such as ionized air, injected in tubes 5 or 5' (shown in FIGS. 9 and 10) laps fragments 30, stuck to the walls owing to electrostatic forces, and allows a partial or total neutralization of the electrostatic charge affecting them with an opposite charge present in fluid 8. This way, part of the electric charge present on fragments 30 is transferred to fluid 8. A similar phenomenon occurs simultaneously and symmetrically for an opposite charge induced on the inner surface 5*b* of the container at the point of adhesion of the fragments 30, in order to achieve the result of compensation of the electrostatic charge present respectively on fragments 30 and on tubes 5 or 5', responsible for the sticking force, by conducting fluid 8.

FIG. 3 shows the device 50 for removing fragments, according to the invention, installed just after the cutting zone shown in FIG. 2, where, in particular the glass tubes 5 rest horizontally on a conveying surface 7 and are moved by dragging elements 15 (shown in FIG. 4) in such a way that tubes 5 roll on conveying surface 7, as shown by arrows 55. This way, an end 5*a* of each tube 5 is free in order to be treated by the device 50 for removing fragments.

In FIG. 3 the devices 3, 3' are also shown that control jets 8 and 9, through which the injection of conductor fluid and the final removal of fragments 30 are carried out.

Figure 4:
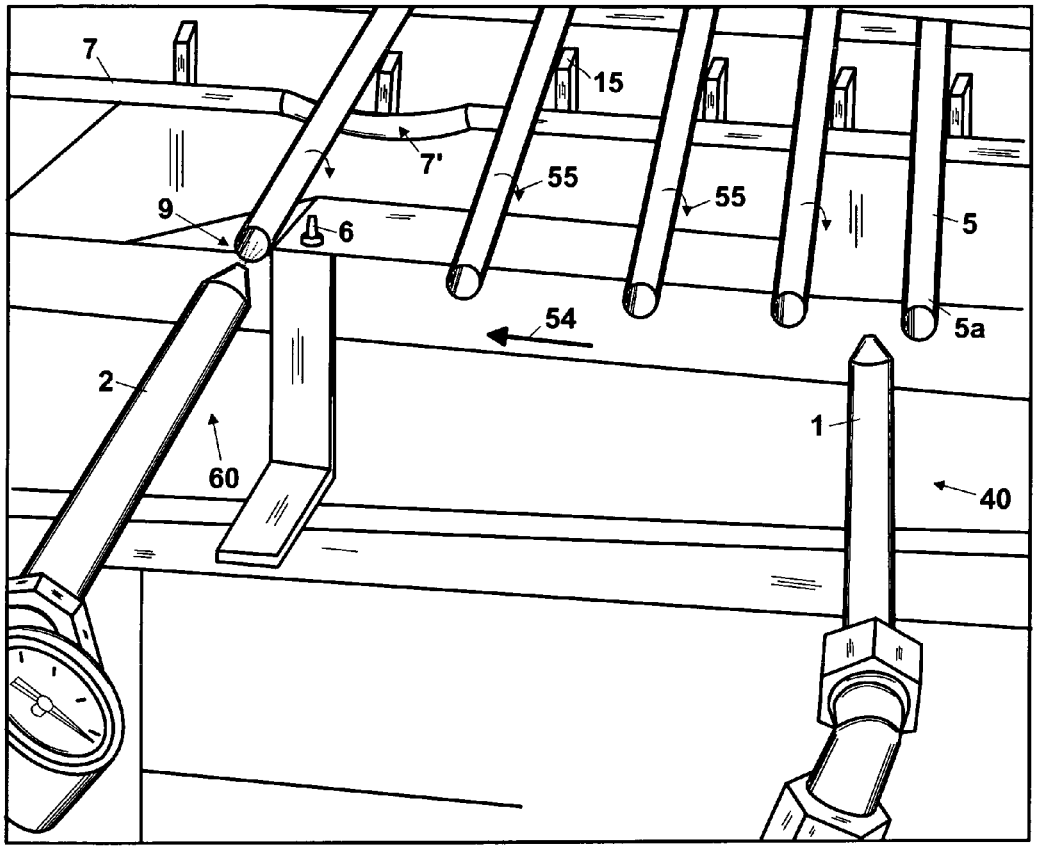
FIG. 4 shows an enlarged view of the device for removing fragments of FIG. 3, outlining the arrangement of the means for adjusting the electrostatic force and of the means for removing the fragments.

FIG. 4 shows an enlarged view of FIG. 3, where the glass tubes 5 passes in succession, according to conveying direction 54 of the production line, through the means for adjusting the charge 40 and the means 60 for removing the fragments. In addition the automatic operation of the above described means is effected by a sensor 6 (shown in FIG. 3) that operates the devices 3 in order to limit fluid consumption and to improve the production rate.

In particular, the electrically conducting fluid 8 and the fluid jet 9 are introduced respectively with different flow rates and outflow speeds with optimized results, with limited consumption of ionized fluid 8 and air jet 9, thus limiting the costs.

Moreover, an element for displacing the fragments from the inner walls of the tube can be provided, as described later on with reference to FIGS. 13-16.

Figure 5:
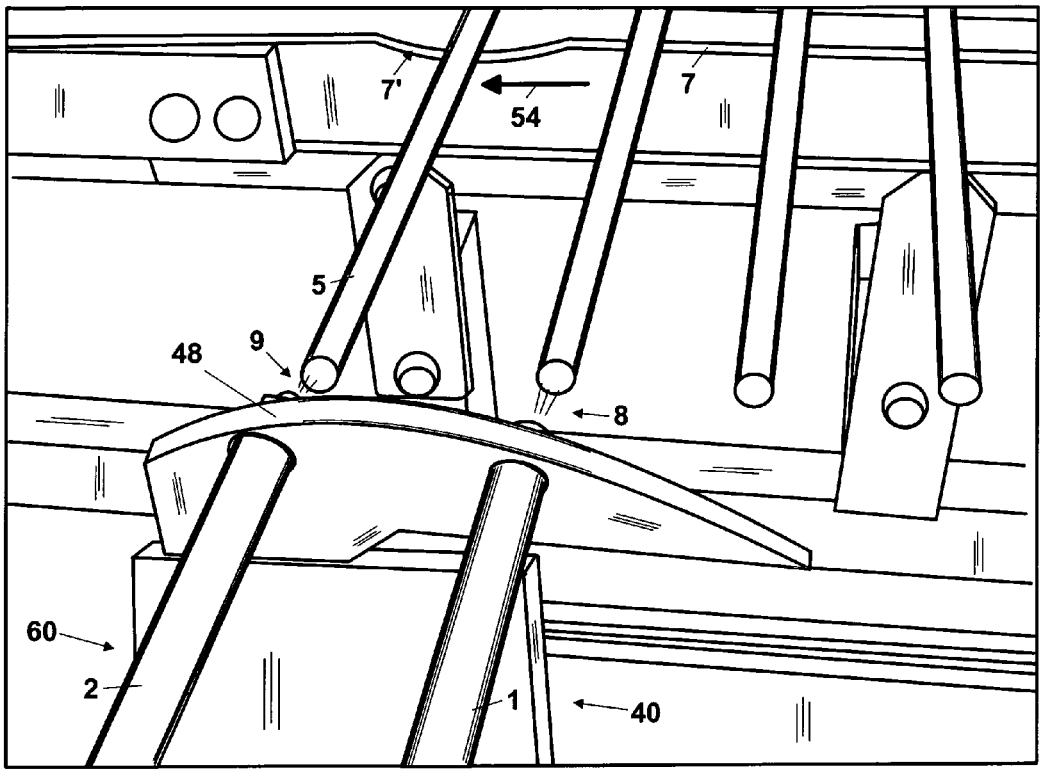
FIG. 5 shows a further exemplary embodiment of the device for removing fragments, according to the invention.
Figure 6:
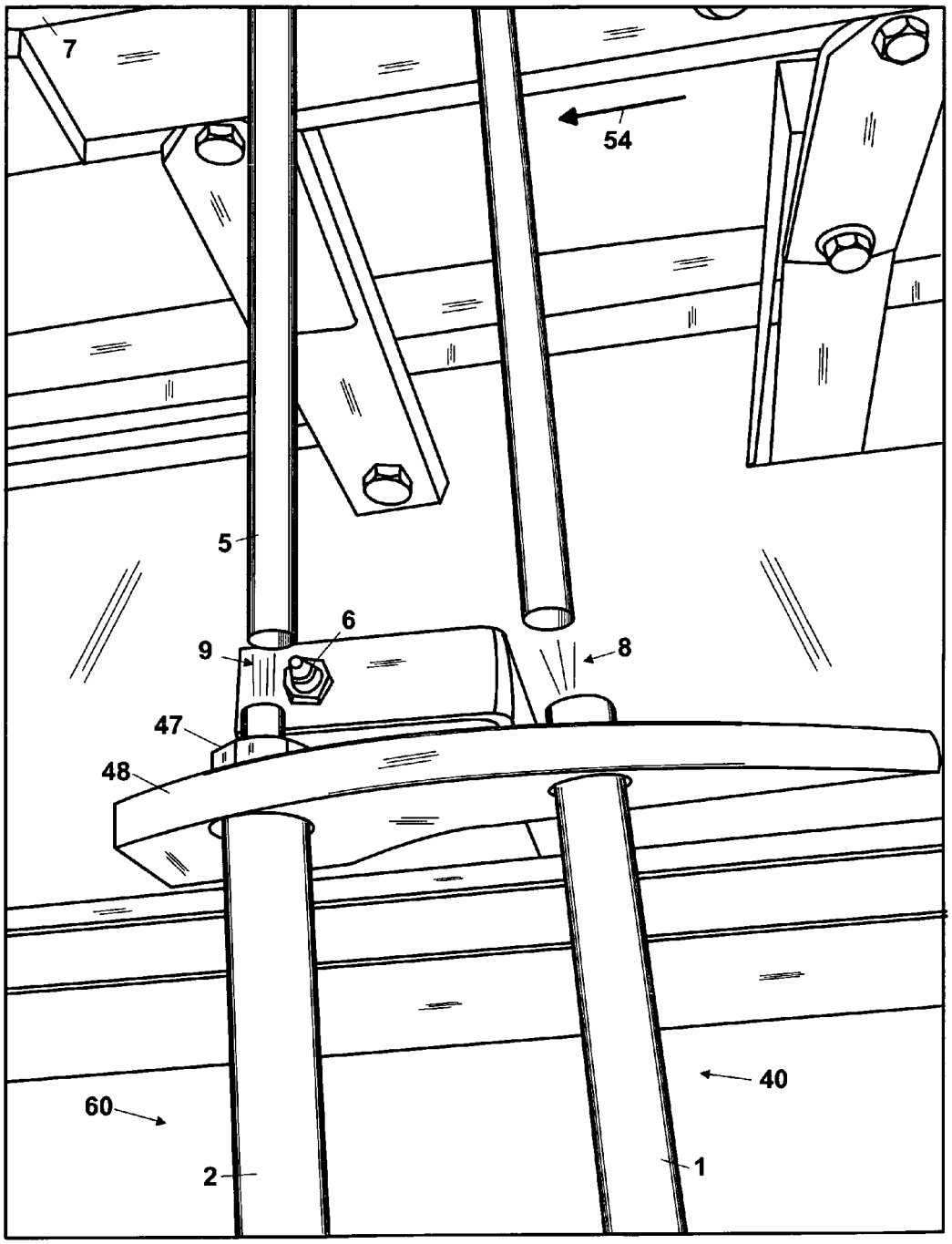
FIG. 6 shows an enlarged view of the device of FIG. 5 where the activation sensor is shown.

FIG. 5 and FIG. 6 show, with two different perspectives with respect to the above described figures, another exemplary structure of the particles removal device 50. In particular, this embodiment provides a single support 48 for two nozzles 1 and 2. Furthermore, a nozzle 47 is shown that can be replaced with another one, responsive to the diameter of tubes 5, in order to optimize the flow and the effect of the device in the containers.

According to the above, the device shown in FIGS. 5 and 6 adopts sensor 6 that are adapted to operate automatically, by means of a solenoid valve, fluid jet 9 and the means for removing 60, to expel definitively fragments 30 that are stuck on the inner surfaces of tubes 5. In FIG. 6 the location of sensor 6 is shown.

Figure 7:
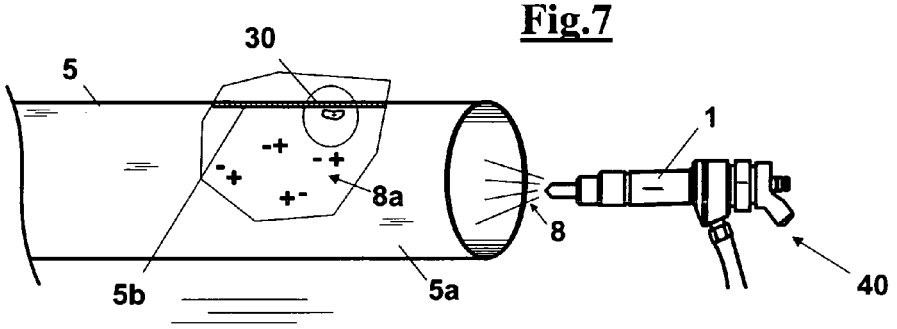
FIG. 7 shows, in detail, the action of the electrically conducting fluid on the fragments stuck on the walls of the container, with the enlarged cross sections 7A and 7B that show the particle stuck on the inner surface, in a first step, during and after the application of the ionized fluid.
Figure 7A:
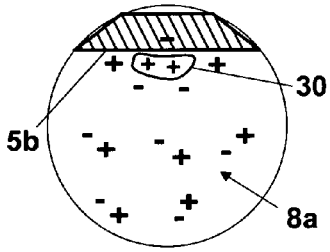
Figure 7B:
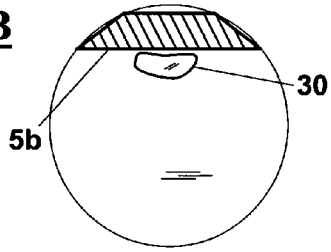

FIG. 7 and the relative enlarged views 7A and 7B depict diagrammatically the effect that cause the electrically conducting fluid 8 to be injected in the tubes 5. In particular, fluid 8, such as a ionized air stream, laps fragments 30 that are stuck by the electrostatic forces on inner surface 5*b* of tubes 5. The positive and negative ions 8*a* present in fluid 8 interact with fragments 30 causing a migration of electrons, thus reducing the charge of fragments 30 and therefore their sticking force. This phenomenon occurs simultaneously also on inner surface 5*b* of container 5, compensating the two opposite charges, the longer ions 8*a* remain in tubes 5 with high concentration, the higher is the removal efficiency (FIG. 7A).

Figure 8:
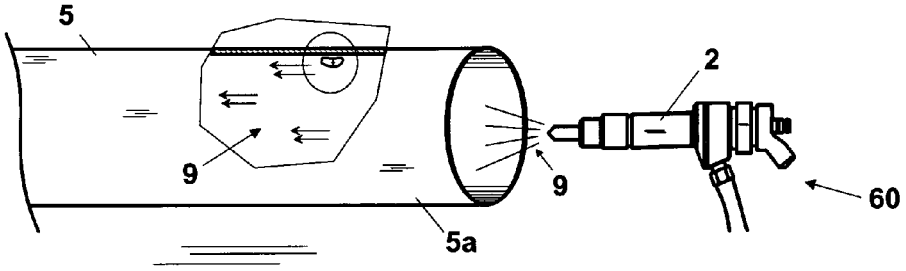
FIG. 8 shows a second step further to FIG. 7, where a jet of fluid, of measured speed, carries out the final removal of the fragments, with the enlarged cross section 8A that shows the particle that is detached from the inner surface.

The successive step, shown in FIG. 8, uses a fluid jet 9, of measured speed, which draws easily the fragments 30 away from the inner surfaces 5*b* of the tubes 5, since the electrostatic force that causes them to stick to the wall 5*b* of the container is now reduced and/or eliminated by the previous treatment with the ionized air 8.

Figure 8A:
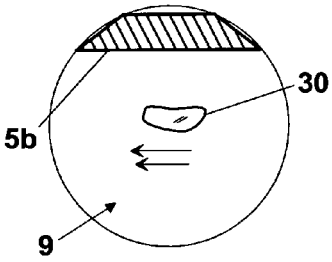

In particular, the success of the fluid jet 9 removing completely all particles 30 is always achieved when the particles have been previously displaced from inner surface 5*b*, as shown in FIG. 8A.

According to a not shown exemplary structure, the means for adjusting the electrostatic force 40 and the means for removing 60 are arranged to act on a same container on the automatic production line. In this case, the electrically conducting fluid 8 and the fluid jet 9 are mixed according to a determined ratio or the electrically conducting fluid 8 works at the same time as medium for adjusting the electric charge 40 and as medium 60 for removing fragments 30. This configuration is structurally compact and can be optimized in order to maximize the fragment extraction efficiency 30.

Figure 9:
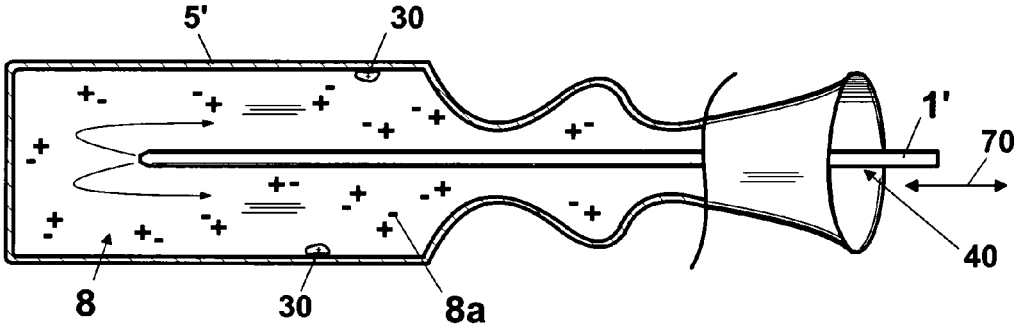
FIG. 9 shows a container having a closed end where the means for adjusting the electrostatic force is introduced.
Figure 10:
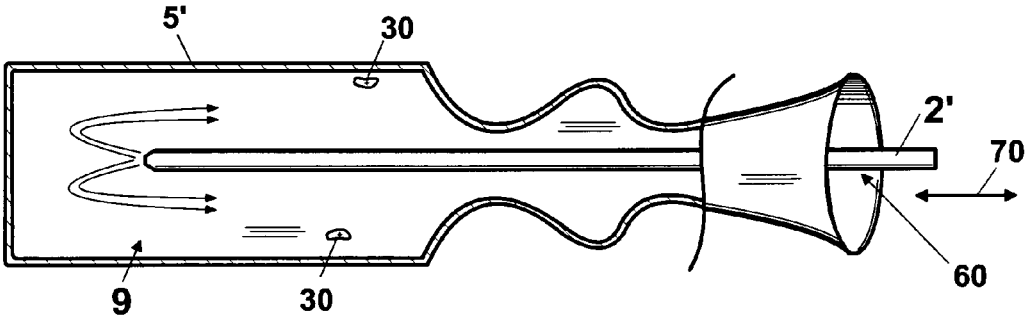
FIG. 10 shows a successive step with respect to FIG. 9 where, in succession, the means for removing the fragments in the container having a closed end are put.

In a further exemplary embodiment, shown in FIGS. 9 and 10, the means for adjusting the electric charge 40 and the means for removing 60 are introduced beyond the aperture of tubes 5', according to a determined depth. This solution, as shown in FIGS. 9 and 10, is effective and adapted to tubes 5' having a closed end.

This way, the electrically conducting fluid 8 and the fluid jet 9 have a wider field of action and can lap the fragments 30 located on the bottom of the same.

In particular FIG. 9 shows a needle-like nozzle 1' of measured shape and size that is put in the container which has a closed end 5'. This way, the ionized air flow 8 exiting from needle-like nozzle 1' has a speed and a movement suitable to feed ions 8*a* onto each surface and therefore each fragment 30 in container 5'.

FIG. 10, in analogy to FIG. 9, shows a nozzle 2' put in the container 5' from which the fluid jet 9 comes out that, according to a same operation as above described, achieves each inner zone of container 5' and captures each fragment 30.

Such solution solves effectively the particular quality requirements for this kind of tubes 5' having a closed end. In particular such tubes 5' are in some cases conceived for being commercialized hermetically closed in order to ensure the maintenance of sterility during transportation and to allow a direct filling without the need of internal washing. This requires further that the final quality is suitable to ensure complete absence of fragments or particles already at the exit from the first production line, i.e. at the moment where the container is closed. Moreover, since the closed tubes are obtained from open tubes as described above, it is very important that the tubes are already free from particles, so that the closed tube containers that are obtained from them have already the least particles possible.

FIG. 11 shows a production line of containers 5' having a closed end and, in particular, a zone where a device for removing the fragments 50' is arranged. In particular it has a first needle 43 from which the ionized fluid flow 8 comes out followed by a succession of nozzles 44 from which air jet 9 comes out for removing the fragments. The particular shape of the needle-like nozzles 43 and 44, once put in the container 5', assists the penetration of the ionized fluid flow 8 and of the air flow 9 thus reaching the end wall and the side walls, as shown in FIGS. 9 and 10.

FIG. 12 shows a second exemplary embodiment, where the means for adjusting the electrostatic force 40' apply an external electrostatic field. The device shown in FIG. 12 comprises a condenser 41 that is adapted to receive the tubes so that they are immersed in an electric field 80. In particular the electric field 80 is switched alternately, between a first and a second configuration of polarity suitable to cause a momentary electrostatic force reduction between fragments 30 and tubes 5.

This way, the tubes 5 that pass through the condenser 41, are subject to a variable external electric field 80 such that the electrostatic force that acts on the fragments 30 stuck on the inner surface 5*b*, and also external surface, is momentarily reduced and/or eliminated and/or inverted. In particular, the configuration of the external electric field can be alternated with a determined timing, or can be modulated according to a plurality of polarities, in order to make, for example, a rotating electric field. This allows adjusting not only the intensity or the sign, but also the direction of the force that acts on the fragments 30, both negative and positive, stuck on the surfaces of the container 5.

The successive step, of extracting the fragments, provides, like in the previous case, the step of displacing the fragments from the inner surface and the contemporaneous introduction of a fluid jet 9 that removes definitively the fragments 30 from the inner surfaces of the containers. However, as shown in FIG. 12, this step is effected simultaneously with the movement of the tubes 5 through the condenser 41, because the change of electrostatic forces that act on the fragments is in this case only temporary, and it is necessary that the jet for the extraction operates during the "detaching" action of the external electrostatic field as well as the displacing action.

A further optimized embodiment, not shown, of the above described particles removal device, includes a combination of the means for adjusting the charge 40 with the means 40' for adjusting momentarily the electric field. In this case, after movement of the tubes 5 through the charged surfaces of the condenser 41, the effect is added of passage of the electrically conducting fluid 8. Just after, or simultaneously, like in the previous case, air jet 9 is supplied for removing the particles.

Furthermore, for reducing further discharge of fragments 30 and particles in the environment, not shown suction devices are provided opposite to the means for adjusting the electrostatic force 40 or 40' and to the means for removing 60, such that a suction can be obtained of the fragments 30 that are being expelled from the tubes 5 or 5' as well as of those coming from the surrounding workspace.

Figure 13:
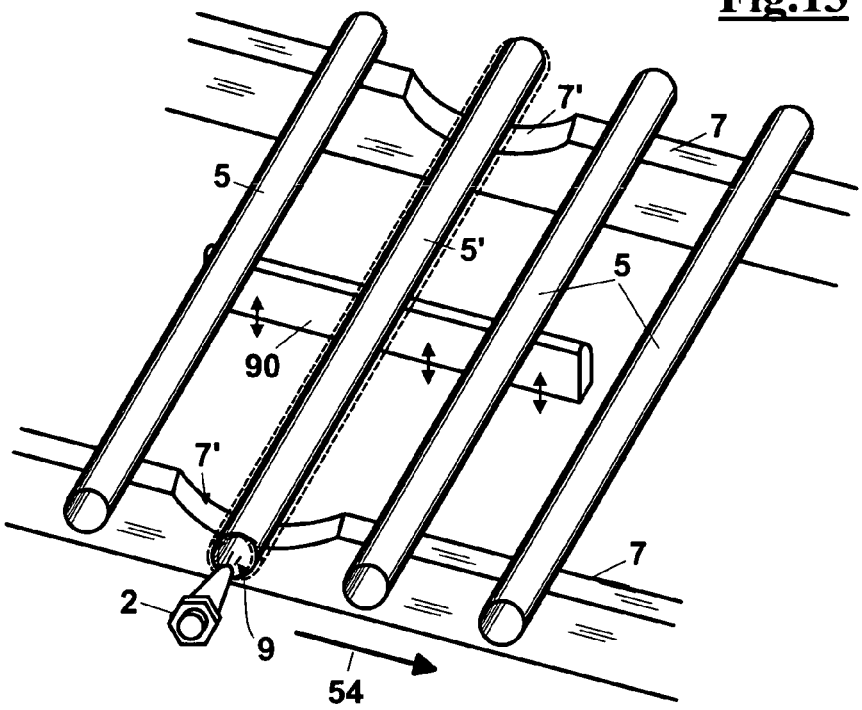
FIGS. 13 and 14 show a schematic view of the production line of containers where a vibrating element is provided, according to the invention for displacing the particles from the surface of the container.
Figure 14:
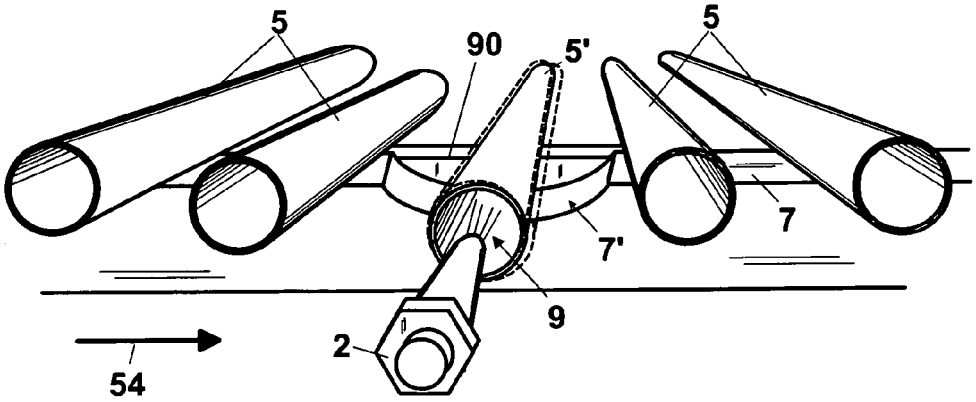

With reference to FIGS. 13 and 14, the means for displacing the particles from the inner surface of the tubes comprises at least one vibrating element, for example a transducer 90, capable of transferring a mechanical momentum of determined frequency, amplitude and polarization, perpendicular to the axis of tube 5, after the operation of said means for adjusting the electrostatic force, or simultaneously to it.

In the first exemplary embodiment of the invention shown in FIGS. 13 and 14, the tube rolls by its own gravity on the transducer surface. In particular, conveying surface 7 is cut in 7' in order to let the tube 5 to roll for a short time on transducer 90.

Figure 15:
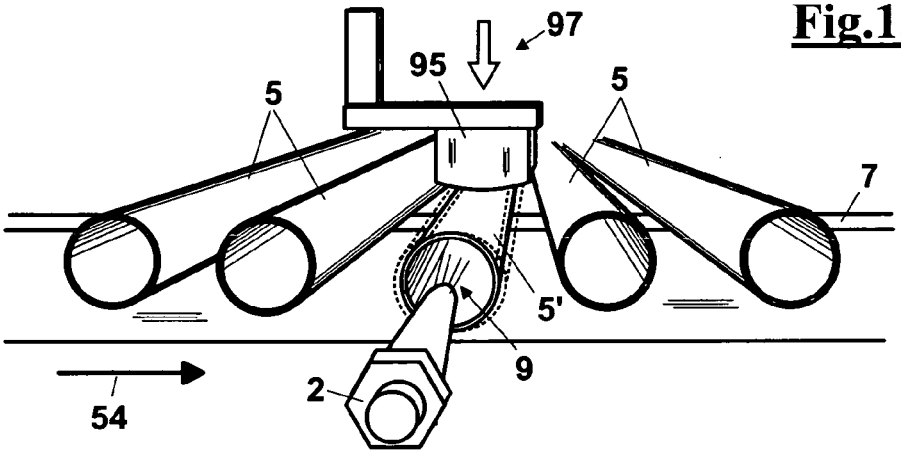
FIGS. 15 and 15A show a further exemplary embodiment of a vibrating element alternative to that shown in FIGS. 13 and 14, according to the invention.
Figure 15A:
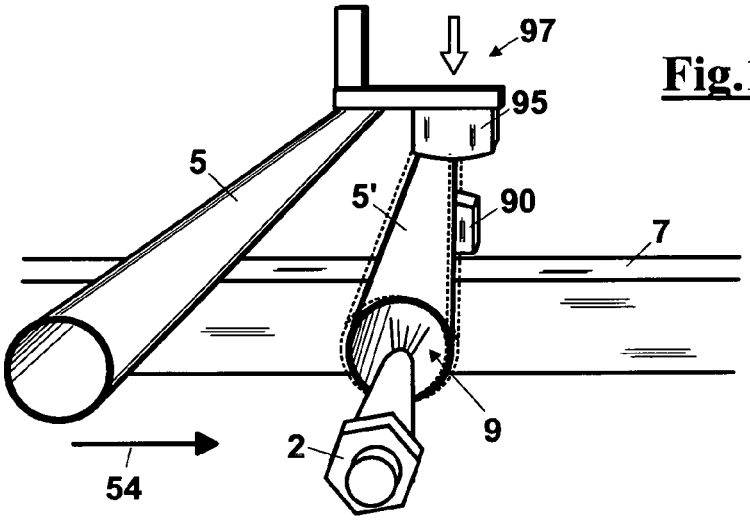
Figure 16:
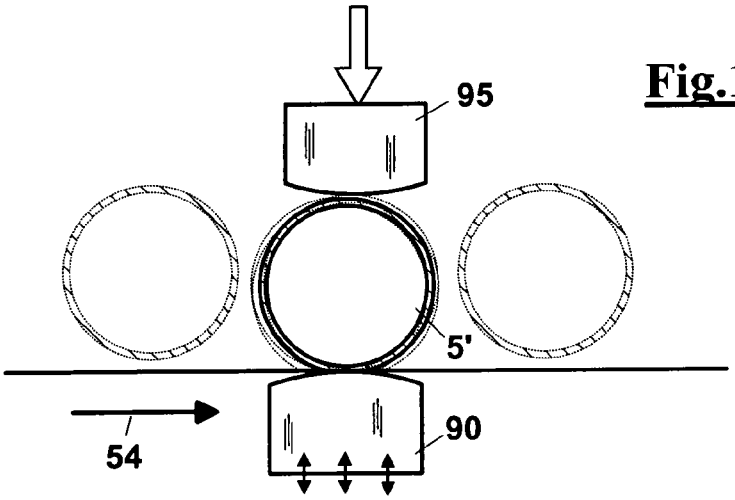
FIG. 16 shows a view of the vibrating element in contact with the outer surface of the tube or container.

Alternatively, as shown in FIGS. 15, 15A and 16, the means for ensuring proper contact with the transducer provides a contrast element 95, for example a rubber padding, which touches glass tubes 5 from above, causing a force 97 to force contact on the vibrating element 90 below.

Figure 18:
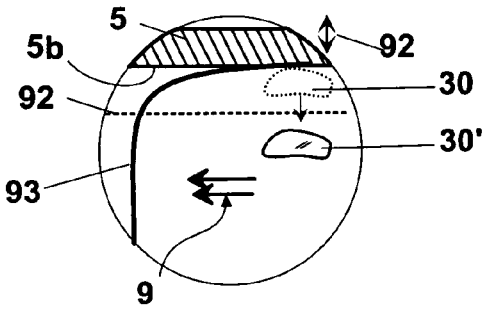
FIG. 18 shows a fragment displaced from the position in which it was within the boundary layer of the air stream.

In particular, the employment of vibrating element 90 causes the fragments to be easily displaced, i.e. lifted off, from the inner surface 5*b* of glass tube 5, as shown in FIG. 18, in order to exploit the effect that the electrostatic force that caused them to stick has been reduced and/or eliminated by the ionized air.

The jet of fluid 9 causes the displaced fragments 30' that have been displaced by the vibration 92 out of the region near the inner surface, called "boundary layer" 91, where the fluid speed is low, and that now are in the zone 93 where the fluid has full velocity, and the fluid can effectively drag the fragments away and out of the glass tubes or containers obtained from glass tubes. In particular, fragments 30, even if electrically discharged, do not exploit full fluid speed and is not dragged away effectively. Instead, a fragment 30' that has been lifted off the inner surface, in an area where fluid speed is full, can be effectively dragged away.

Figure 17:
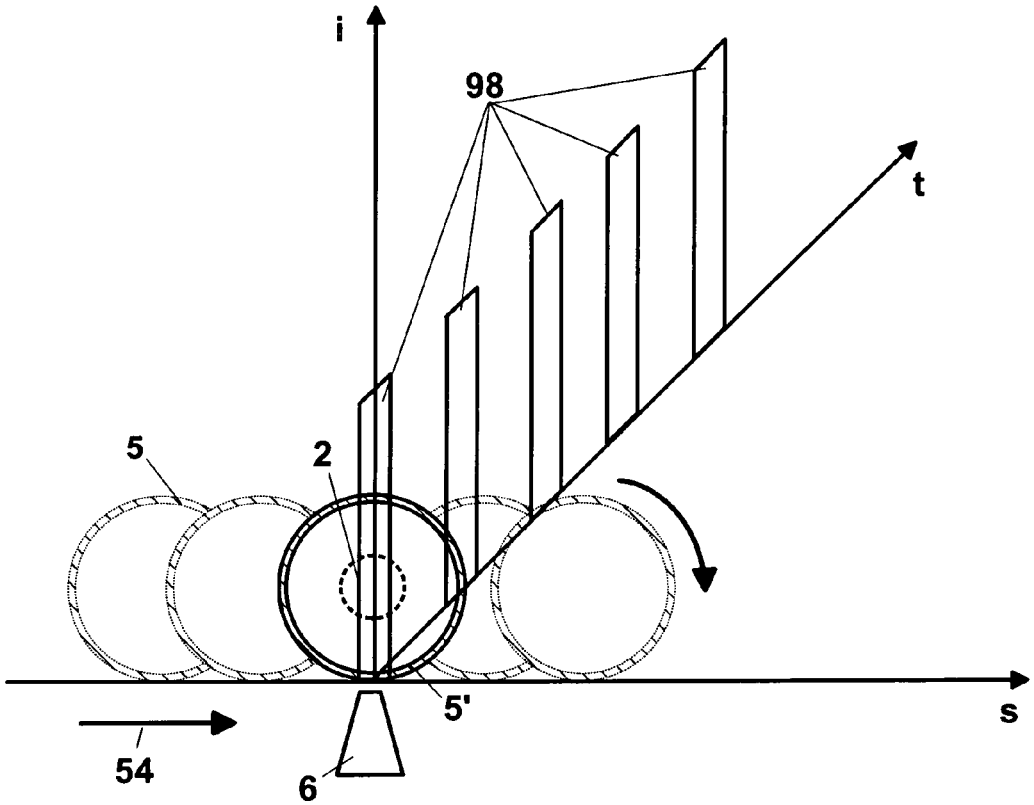
FIG. 17 shows a schematic diagram of the steps of removing that occur by pulsed jets that occur when a sensor signals the alignment of the tube with the air nozzle.

With reference to FIG. 17, air jets 9 are advantageously pulsed jets, that are triggered only when the tube 5 passes, in a way signalled by sensor 6, at nozzle 2. Air jet pulses 98 are therefore distanced from each other by time intervals, according to the pace with which tubes 5 reach the position 5' aligned with nozzle 2.

The foregoing description of a specific embodiment will so fully reveal the invention according to the conceptual point of view, so that others, by applying current knowledge, will be able to modify and/or adapt for various applications such an embodiment without further research and without parting from the invention, and it is therefore to be understood that such adaptations and modifications will have to be considered as equivalent to the specific embodiment. The means and the materials to realise the different functions described herein could have a different nature without, for this reason, departing from the field of the invention. It is to be understood that the phraseology or terminology employed herein is for the purpose of description and not of limitation.

The invention claimed is:

1. A method for removal of glass fragments from glass tubes, or glass containers obtained from glass tubes, on automatic production lines, where said glass tubes, or said glass containers obtained from glass tubes have an axis and are conveyed on a conveying line with said axis lying horizontally, the method comprising the steps of:

conveying said glass tubes, or glass containers obtained from glass tubes, such that said axis is lying horizontally;

changing, by reducing or eliminating, the electrostatic force between said glass fragments and the inner surface of said glass tubes, or glass containers obtained from glass tubes by passing said glass tubes, or glass containers obtained from glass tubes between opposing surfaces creating an external electric field, wherein a direction of said electric field is switched alternately through a plurality of polarities;

displacing, by using a vibrating element, said glass fragments from the inner surface of said glass tubes, or glass containers obtained from glass tubes, while keeping said axis lying horizontally; and removing, while keeping said axis lying horizontally, said glass fragments away from the inner surface of said glass tubes, or glass containers obtained from glass tubes;

wherein said step of removing is carried out introducing along said axis lying horizontally at least one horizontal jet of fluid with a measured speed in said glass tubes, or glass containers obtained from glass tubes, said jet of fluid flowing into said glass tubes, or glass containers obtained from glass tubes, horizontally and exiting from said glass tubes, or glass containers obtained from glass tubes horizontally dragging said glass fragments away.

2. The method according to claim 1, wherein said steps of changing and displacing and said step of removing are carried out in a way selected from the group consisting of:

at three successive stations along said conveying line for said glass tubes, or glass containers obtained from glass tubes;

in two stations, along said conveying line for said glass tubes, or glass containers obtained from glass tubes; and in one single station, along said conveying line for said glass tubes, or glass containers obtained from glass tubes.

3. The method according to claim 1, wherein said step of changing the electrostatic force provides introducing an electrically conducting fluid with a measured resistivity in said glass containers.

4. The method according to claim 3, wherein said electrically conducting fluid with a measured resistivity is obtained by ionizing an electrically neutral gas.

5. The method according to claim 4, wherein said step of ionizing said electrically neutral gas comprises causing collisions between molecules of said electrically neutral gas by suitably intense electric fields, in such a way that a subtraction or addition or exchange of electrons between said molecules and a rapid increase of the fraction of said molecules is obtained, which are eventually electrically charged.

6. The method according to claim 1, wherein said glass tubes, or glass containers obtained from glass tubes have an axis, and said step of displacing is obtained by communicating a mechanical momentum to said glass fragments perpendicular to said axis, said mechanical momentum is obtained by applying vibrations of determined frequency, amplitude and polarization, to the outer surface of said glass tubes, or glass containers obtained from glass tubes.

7. The method according to claim 1, wherein said vibrating element includes a means for ensuring proper contact with said glass tubes, or glass containers obtained from glass tubes.

8. The method according to claim 7, wherein the means for ensuring proper contact are based on letting the glass tubes, or glass containers obtained from glass tubes lay by their own gravity on a transducer surface.

9. The method according to claim 6, wherein said vibrations have frequencies that are higher than 50 Hz.

10. The method according to claim 1, wherein the displacing step is carried out in a station coincident with the removing step.

11. The method according to claim 3, wherein said steps of changing and removing occur in a same station and said step of displacing occurs simultaneously with both steps of changing and removing, and wherein said electrically conducting fluid works at the same time as a medium for adjusting the electrostatic force and as a medium for removing the glass fragments.

12. The method according to claim 1, wherein said step of changing the electrostatic force acting on said glass fragments and said glass tubes, or glass containers obtained from glass tubes is temporarily reduced or reverted.

13. The method according to claim 12, wherein said step of changing and removing occur in a same station and wherein during a passage through said capacitor, an introduction in said glass tubes, or glass containers obtained from glass tubes of a jet of fluid is made.

14. The method according to claim 3, wherein the step of changing and removing occur with both an injection in said glass tubes, or glass containers obtained from glass tubes of the electrically conducting fluid and, at the same time, an immersion of said glass containers in an external electric field.

15. The method according to claim 1, wherein a suction step is provided adapted to receive said jet of fluid after said jet of fluid exits from said glass tubes or glass containers obtained from glass tubes, to prevent removed glass fragments from contaminating the environment, and to provide an enhanced pressure difference to said jet.

16. The method according to claim 1, wherein said fluid is air.

17. The method according to claim 4, wherein said electrically neutral gas is air.

18. The method according to claim 7, wherein the means for ensuring proper contact provides a contrast element which touches said glass tubes or containers obtained from glass tubes from above forcing contact on the vibrating element below.

19. The method according to claim 6, wherein the vibrations have frequencies that are higher than 1 KHz.

20. The method according to claim 6, wherein the vibrations have frequencies that are higher than 20 KHz.

21. The method according to claim 1, wherein said step of changing the electrostatic force provides the introduction of an electrically conducting fluid with a measured resistivity in said glass tubes, or glass containers obtained from glass tubes and the steps of changing and removing occur at two successive stations, wherein said step of displacing occurs simultaneously with said step of removing, and said electrically conducting fluid and said jet of fluid are introduced respectively with different flow rates and outflow speeds in order to enhance the effect of both the electrically conducting fluid and the fluid for removing the fragments.

22. The method according to claim 1, wherein said glass tubes, or glass containers obtained from glass tubes, roll on a conveying surface.

23. The method according to claim 1, wherein the electric field is switched between a first negatively charged configuration and a second positively charged configuration of polarity to cause a momentary electrostatic force reduction between the fragments and the glass tubes, or glass containers obtained from glass tubes and then the electric field is switched back to the first negatively charged configuration.

* * * * *